US006977570B2

(12) United States Patent
Gilmore

(10) Patent No.: US 6,977,570 B2
(45) Date of Patent: Dec. 20, 2005

(54) REED SWITCH APPARATUS

(76) Inventor: Glendell N. Gilmore, P.O. Box 690851, Houston, TX (US) 77269-0851

( * ) Notice: Subject to any disclaimer, the term of this patent is extended or adjusted under 35 U.S.C. 154(b) by 0 days.

(21) Appl. No.: 10/369,004

(22) Filed: Feb. 19, 2003

(65) Prior Publication Data

US 2004/0160296 A1 Aug. 19, 2004

(51) Int. Cl.[7] ..... H01H 9/00
(52) U.S. Cl. ..... 335/207; 335/205; 335/152
(58) Field of Search ..... 335/151–154, 335/202, 205–207; 340/547, 545, 545.6–545.7

(56) References Cited

U.S. PATENT DOCUMENTS

| | | | | |
|---|---|---|---|---|
| 3,544,934 A | | 12/1970 | Poliakoff | |
| 4,170,005 A | * | 10/1979 | Duke | 340/547 |
| 4,210,889 A | | 7/1980 | Holce | |
| 4,258,346 A | | 3/1981 | Williams | |
| 4,319,712 A | * | 3/1982 | Bar | 236/47 |
| 4,409,577 A | | 10/1983 | Holce et al. | |
| 4,465,997 A | | 8/1984 | Hines | |
| 4,988,965 A | | 1/1991 | Borja | |
| 5,243,325 A | | 9/1993 | Marin et al. | |
| 5,559,482 A | * | 9/1996 | Close et al. | 335/151 |
| 5,576,678 A | | 11/1996 | Saunders | |
| 5,589,811 A | | 12/1996 | Pariot et al. | |
| 5,633,626 A | | 5/1997 | Cawthorne | |
| 5,668,533 A | | 9/1997 | Jackson, Jr. et al. | |
| 5,723,835 A | * | 3/1998 | Gilmore | 200/61.71 |
| 5,754,107 A | | 5/1998 | Ferrantelli | |
| 5,777,552 A | | 7/1998 | Fischette et al. | |
| 5,877,664 A | | 3/1999 | Jackson, Jr. | |
| 6,011,469 A | | 1/2000 | Taft et al. | |
| 6,225,903 B1 | | 5/2001 | Soloway et al. | |
| 6,249,224 B1 | | 6/2001 | Shoen et al. | |
| 6,310,548 B1 | * | 10/2001 | Stephens et al. | 340/540 |
| 6,348,861 B1 | | 2/2002 | Li | |
| 6,359,538 B1 | | 3/2002 | Jolley et al. | |
| 6,400,267 B1 | | 6/2002 | Gordon-Levitt et al. | |

OTHER PUBLICATIONS

*Introduction to the Digital Sensor*, http://www.crime-prevention-products.com/closet.htm , printed May 14, 2003, 1 page, date of first publication, unknown.

*Electric Door Light Switch*, http://www.smarthome.com/5188.html, printed May 14, 2003, 1 page, date of first publication, unknown.

*Closet light and other night lights and other parts in electrical at AubuchonHardware.com*, http://electrical.aubuchonhardware.com/wiring_and_boxes/night_lights_and _other_parts/closet_light-514233.asp, printed May 14, 2003, 1 page, date of first publication, unknown.

(Continued)

*Primary Examiner*—Lincoln Donovan
(74) *Attorney, Agent, or Firm*—Douglas W. Rommelmann; Andrews Kurth LLP

(57) ABSTRACT

A reed switch apparatus utilizes one or more reed switches to communicate with one or more devices. In one configuration, the reed switch apparatus utilizes a single magnetic field to simultaneously activate two or more reed switches. In another configuration, two or more reed switches, each acting independent of one another are simultaneously activated by a single magnetic field. Additionally, a method of controlling at least two devices includes exposing a reed switch apparatus to a single magnetic field. Yet another method includes a activating a device via the use of a single reed switch mounted to a portion of a warehouse structure.

29 Claims, 7 Drawing Sheets

OTHER PUBLICATIONS

*Learn how to install an electric switch at AubuchonHardware.com by AubuchonHardware.*, http://electrical.aubuchonhardware.com/do__it__yourself__ projects/how__to__install__an__electric__switch.asp , printed May 14, 2003, 8 pages, date of first publication, unknown.

*Quick Switch*—p. 13, printedMay 16, 2003, 1 page, date of first publication, unknown.

*Door Alarm Detail, Roll-Up Door Contact*, ftp://216.89.18.228/web/draw/Roll__Up__Door__Contact—.01.pdf printed May 16, 2003, 1 page, (date of first publication, Feb. 24, 1998).

* cited by examiner

FIG. 7
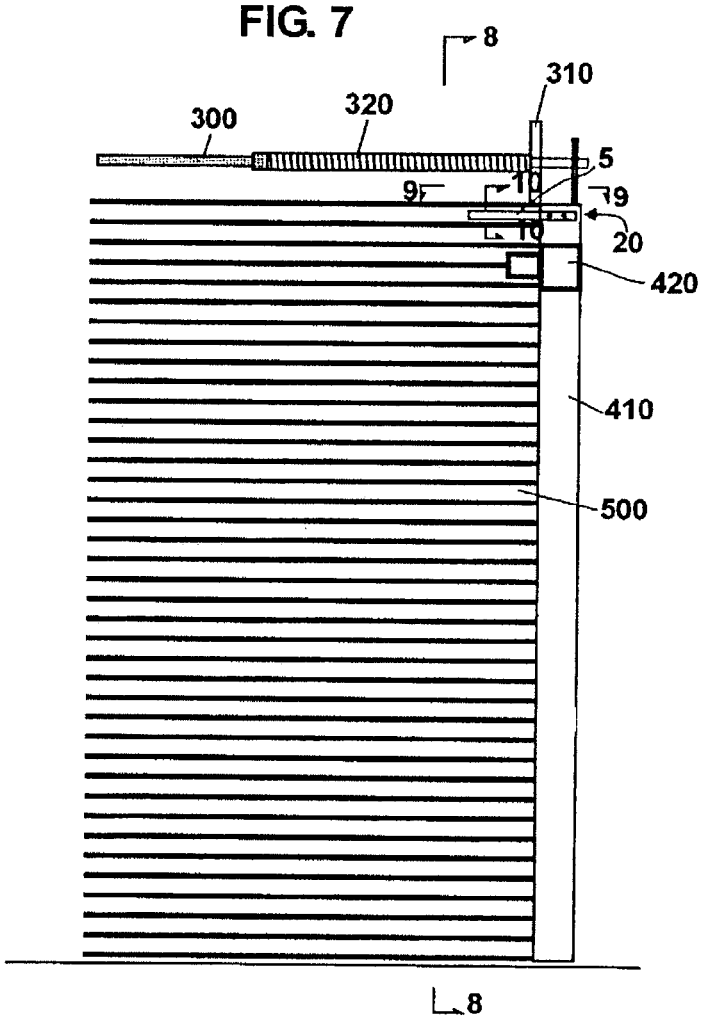
FIG. 8
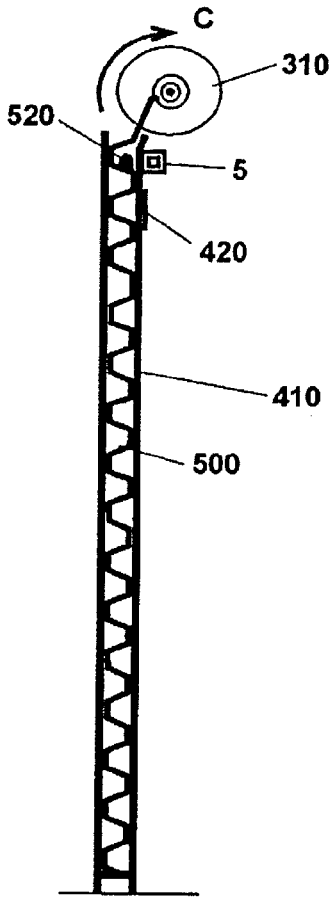
FIG. 9
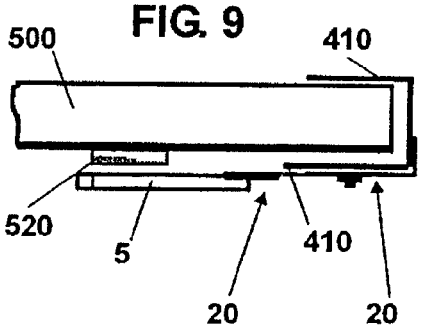
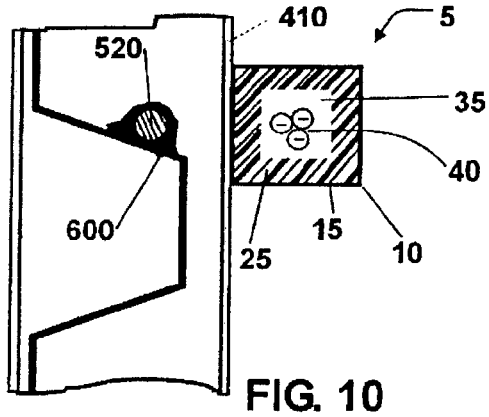
FIG. 10

FIG. 13
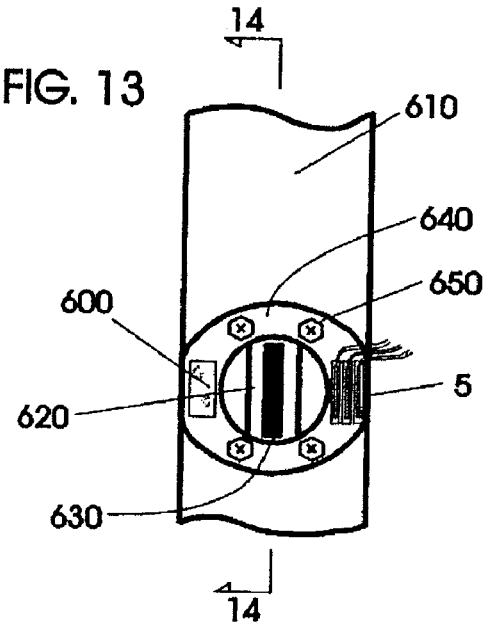
FIG. 13A
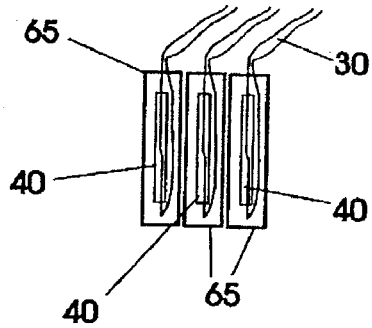
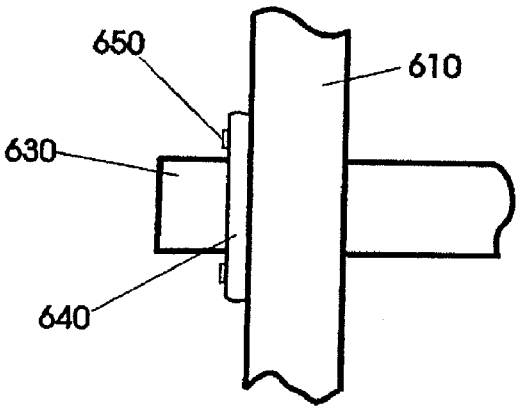
FIG. 14

REED SWITCH APPARATUS

CROSS-REFERENCE TO RELATED APPLICATIONS

Not Applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to reed switches and more specifically to the use of one or more reed switches to control one or more devices 2. Description of the Related Art Reed switches are magnetically operated switches, which are generally formed by a pair of spaced ferromagnetic contacts or blades, hermetically sealed in a glass capsule. In a typical application and use of a reed switch, the blades are connected to outside leads—each outside lead being part of a circuit. The exposure of the blades to a magnetic field—coming from either a permanent magnetic or electromagnetic generation—forces the blades to move, either contacting one another or moving a way from one another. In what is known as a normally closed reed switch ("Normal" in this sense and as will be used herein means a state where the reed switch is exposed to a magnetic field), the blades touch when exposed to a magnetic field. By removing the magnetic field, the normally closed reed switch opens and the contacts will no longer touch. Contrariwise, in a normally open reed switch, the contacts touch in the absence of a magnet. By exposing the normally open reed switch to the magnetic field, the contacts move apart and the circuit is opened. After the magnetic field has been removed from these reed switches, the blades will return to their original position.

Generally, the reed switch is activated (that is, causing the ferromagnetic blade to move, be it closing the circuit or opening the circuit) via the use of a magnetic field. Such an activation allows communication to be established with a system or device. In some instances the communication may be the lack of a signal or electrical energy being returned when the switch opens the circuit, while in other instances, the communication may be the circuit being completed. One recognized use of a reed switch is monitoring the "change of state" of something in security systems. For example, a reed switch can cause a circuit to be completed or broken when a window or door opens or closes. This change of condition (opening or closing of the circuit) can automatically be detected by a central alarm system or the like, indicating whether or not an unauthorized "change of state" has occurred. A typical security use of such a reed switch may be, for example, on a window or door of a house or on a roll-up door of a storage shed.

With the use of reed switches to control a device, several design considerations must be taken into account. Reed switches are by their very nature fragile—that is, the glass capsules can break. An exacerbation of the fragile nature is the likelihood that two reed switches may be in too close of proximity to one another, hitting and breaking each other.

SUMMARY OF THE INVENTION

The present invention includes in one embodiment a reed switch apparatus having a plurality of reed switches which communicate with a plurality of devices. In one configuration, the reed switch apparatus has been arranged and designed such that a single magnetic field can simultaneously activate all of the plurality of reed switches. In another configuration, two or more reed switches, each acting independent of one another are simultaneously activated by a single magnetic field.

The present invention also includes as another embodiment a method of controlling a plurality of devices with a reed switch apparatus having a plurality of reed switches. When the reed switch apparatus is exposed to a single magnetic field, the plurality of reed switches are activated. The activation of the plurality of reed switches facilitates the communication with each of the plurality of devices. Yet another embodiment of the invention includes a method of activating a device via the use of a single reed switch mounted to a portion of a warehouse structure.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 7 shows another embodiment of the reed switch apparatus, illustrating one use of the reed switch apparatus;

FIG. 8 shows a cross sectional view cut across lines 8—8 of FIG. 7;

FIG. 9 shows a cross sectional view cut across lines 9—9 of FIG. 7;

FIG. 10 shows a cross sectional view cut across lines 10—10 of FIG. 7;

FIGS. 13 and 13A show another embodiment of the reed switch apparatus, having multiple housings; and FIG. 14 shows a cross sectional view cut across lines 14—14 of FIG. 13.

DETAILED DESCRIPTION OF THE INVENTION

Figure 2:
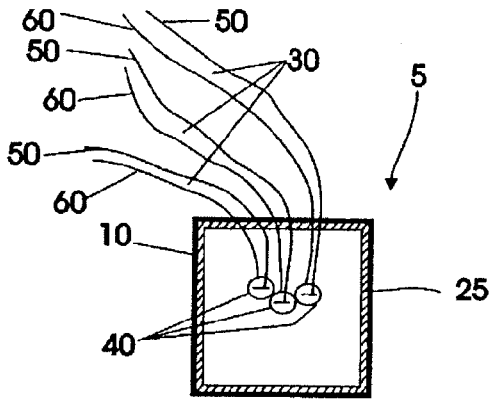
FIG. 2 shows a cross sectional view of the reed switch apparatus, cut across lines 2—2 of FIG. 1.
Figure 1:
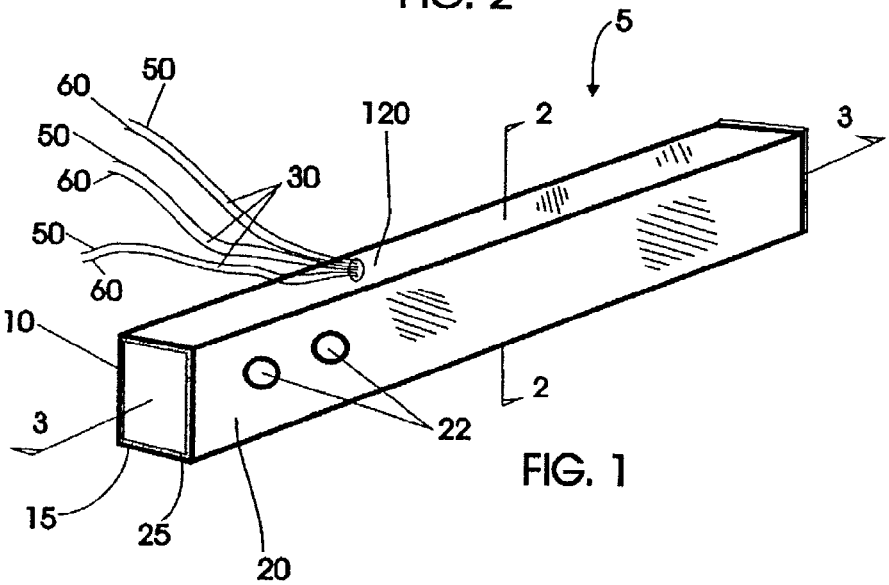
FIG. 1 shows an embodiment of the reed switch apparatus in an isolated view.
Figure 3:
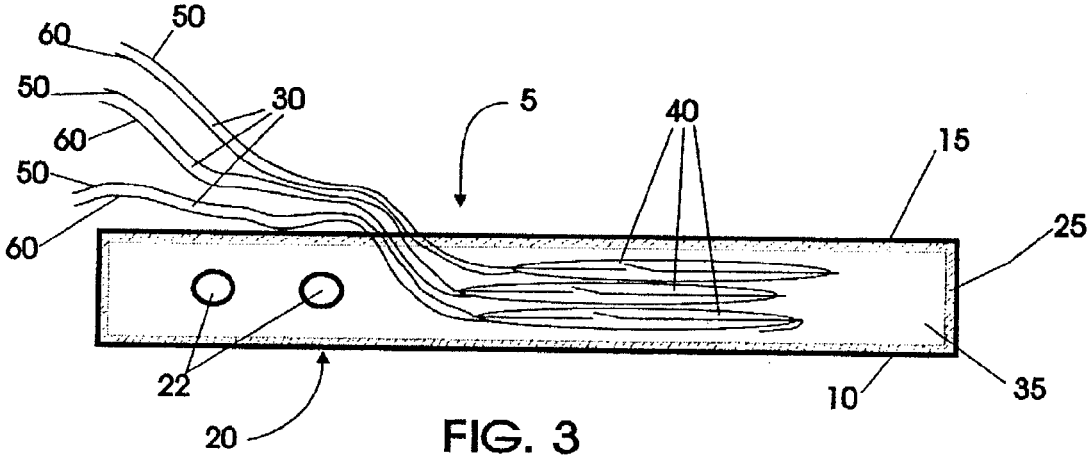
FIG. 3 shows a cross sectional view of the reed switch apparatus, cut across lines 3—3 of FIG. 1.

Several different embodiments, not drawn to scale, are shown in FIGS. 1–14, illustrating several concepts of the invention. FIGS. 1–3, in several views show a first embodiment of a reed switch apparatus 5. The reed switch apparatus 5 in this embodiment includes a reed switch housing 10, a plurality of reed switches 40 (FIG. 3) and a attachment device 20. The reed switch housing 10 includes an outer body 15, which is arranged and designed as an outermost protective coating for the reed switches 40. The choice of material for outer body 15 can vary with design and intended use, but preferably the material is of such a nature that it is non-magnetic—or, will not interfere with the magnetic action of reed switches—and is strong and rigid enough to maintain its position when mounted to a specific object, e.g., a door or window. Suitable material for outer body 15 would include aluminum and plastic. The outer body 15 of the reed switch housing 10 can be of such a nature that it will absorb much of the impact caused by shock and forces that may be imparted to the reed switch housing 10 and ultimately the reed switches 40. Such shock and forces are undesirable as they can cause the glass capsules of reed switches 40 to break. While every embodiment may not need additional protective measures, this embodiment includes a buffer to protect the reed switches 40. One such buffer is described in U.S. Pat. No. 5,723,835, issued to Gilmore, which is owned by the applicant of the current application and is herein incorporated in its entirety. Part of the buffer in this embodiment includes resilient material 25, which can be made of any material known for its ability to absorb mechanical energy, namely poly-foam, polystyrene, silicone, polymers and the like. This resilient material 25 fits just inside the outer body 15, preferably fitting flush therewith. In some embodiments, the resilient material 25 can fill the entire reed switch housing 10. In this embodiment, as is preferably the design, the buffer also includes a gas blend 35 placed inside the resilient material 25, which fluidly isolates the reed switches 40. The gas blend 35 suspends the reed switches 40 to help the reed switches 40 from coming in contact with the outer body 15, and also from coming in contact with one another. One such gas blend is an ammonia methanol by-product produced from curing of silicone, when silicone is used as the resilient material 25.

While not shown in the embodiment of FIGS. 1–3, in other embodiments the buffering of the reed switches 40 can include a material, which can absorb mechanical energy, placed on the outside of the reed switches 40. Such materials can include shrink-wrapped plastic, a rubber coating, or the like.

While the reed switch housing 10 shown in FIGS. 1–3 has been shown with reference to one central compartment or cavity that houses all the reed switches 40, other embodiments may include a reed switch apparatus 5 which utilizing several compartments or housing. One such example is described with reference to FIG. 13A, below. The dynamics, intended use, and materials ultimately used will to a certain degree dictate the type of structure which can be used for reed switch device 5 and corresponding housing for the reed switches 40.

Referring to FIG. 2, extending from the reed switch housing 10 at opening 120 (FIG. 1) are leads 30, attached to the reed switches 40. In this embodiment, a pair of leads 30 correspond to each reed switch 40. Each pair of leads 30 include a common 50 and a switch control signal 60. As shown in FIGS. 2 and 3, the reed switches 40 are in such proximity to one another that a single magnetic field (not shown) can activate all the reed switches 40. The activation of one of the reed switches 40 can include, as briefly described in the background, the closing of a normally closed switch or the opening of a normally open switch. Once again "normal" in this sense means a state where the reed switch 40 are exposed to a magnetic field (for example, a magnet being within close proximity to the reed switch). While three reed switches 40 are shown, two or more can be used in practice. Additionally, the reed switches 40 can include a combination of switches—including, but not limited to, those described above with reference to this embodiment.

Also shown in this embodiment is attachment device 20. In this embodiment, attachment device 20 comprises mounting hole 22, which facilitates the installation of the reed switch apparatus 5. Other attachment devices 20, which should become apparent to those skilled in the art, can be used—some of which are described in the embodiments below.

In practice, the reed switch apparatus 5 can be placed in a selective location. Upon exposure of the reed switches 40 inside reed switch apparatus 5 to a magnetic field (not shown), the reed switches 40 are activated (opening or closing—depending on the type of reed switch 40 being used), being forced into the normal state. In this embodiment, each of the reed switches 40 can complete or open a circuit via leads 30 through a common 50 and a switch control signal 60, communicating with one of the many devices used in various industries. This communication from reed switches 40, while not shown in this embodiment can be routed to a hardwired device, sent to a control module, or sent to a device which is in wireless communication with one of the leads 30.

Figure 4:
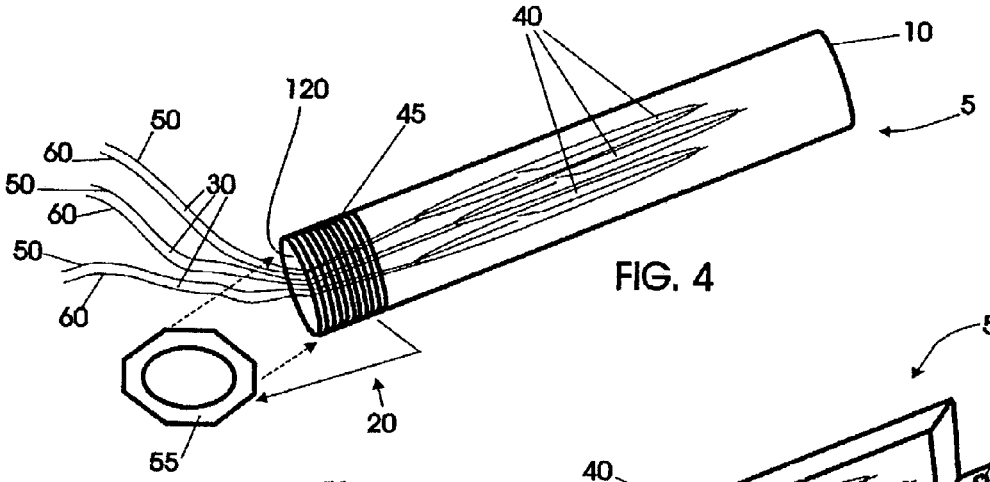
FIG. 4 shows another embodiment of the reed switch apparatus with a threaded round switch housing.
Figure 6:
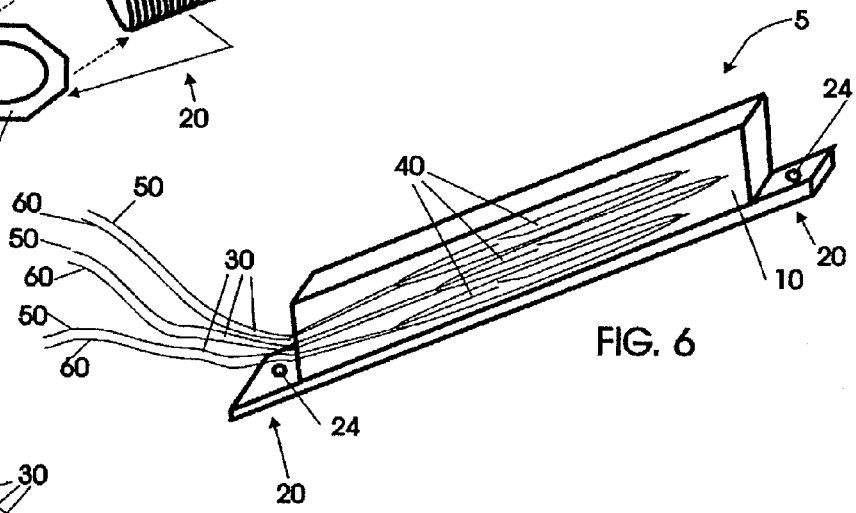
FIG. 6 shows another embodiment of the reed switch apparatus with a housing arranged and designed to fit on a door or window.
Figure 5:
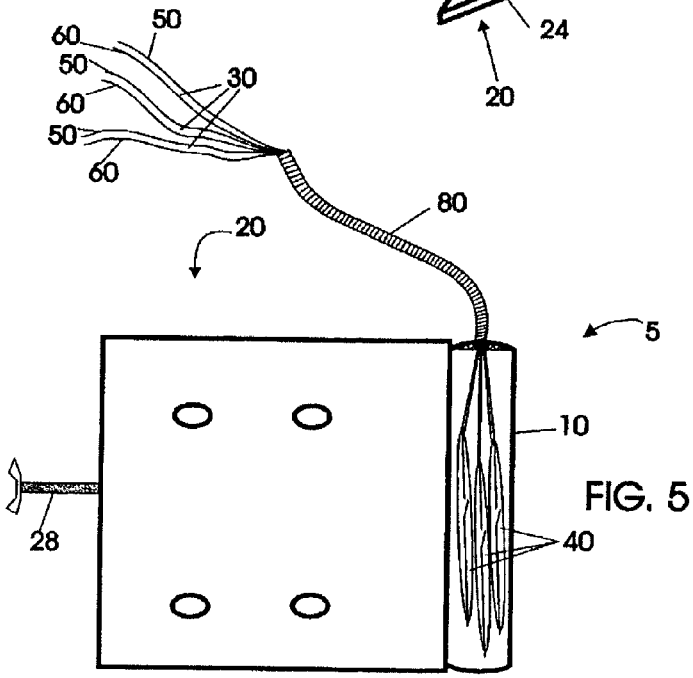
FIG. 5 shows another embodiment of the reed switch apparatus with a housing arranged and designed to be placed on a door track.

FIGS. 4, 5, and 6 each show an alternative embodiment of reed switch apparatus 5. In all three embodiments, the reed switch apparatus 5 operates with a similar concept to that described in FIGS. 1–3, with slight differences. In FIG. 4, the reed switch housing 10 is a threaded round switch housing and three reed switches 40 are being used. The use of a tubular design as will be appreciated by one of ordinary skill in the art of structural dynamics will allow unique structural advantages over other designs. Additionally, the tubular design will allow insertion of the reed switch apparatus 5 in a structure designed to receive round structures—e.g, in the door drum of a roll up door. Shown in phantom view are three reed switches 40 with three sets of leads 30 (also, partially shown in phantom view), connected thereto. The three sets of leads 30 extend out through an opening 120 in the end of the reed switch housing 10. At the end of the reed switch housing 10 and adjacent to opening 120 is the attachment device 20, which in this embodiment includes threading 45, which corresponds to nut 55. While three reed switches 40 have been shown in this embodiment, more can be used in practice.

In FIG. 5, the reed switch housing 10 is arranged and designed to fit on a track of a roll-up door. Shown in phantom view are the three reed switches 40 with three sets of leads 30, connected thereto. In this embodiment, the three sets of leads 30 are fed into an armored cable housing 80 upon exiting the reed switch housing 10. The armored cable housing 80 protects leads 30 outside of the reed switch housing 10. The attachment device 20 in this embodiment includes attachment via wing nut 28.

In FIG. 6, the reed switch housing 10 is arranged and designed to fit on a door or window. Shown in phantom view are three reed switches 40, which connect to the three sets of leads 30. The three sets of leads 30 extend out through an opening 120 (not seen from this point of view) in reed switch housing 10. The attachment device 20 in this embodiment includes attachment holes 24—which a low mounting via the use of nails, screws or pop rivets.

Figure 6A:
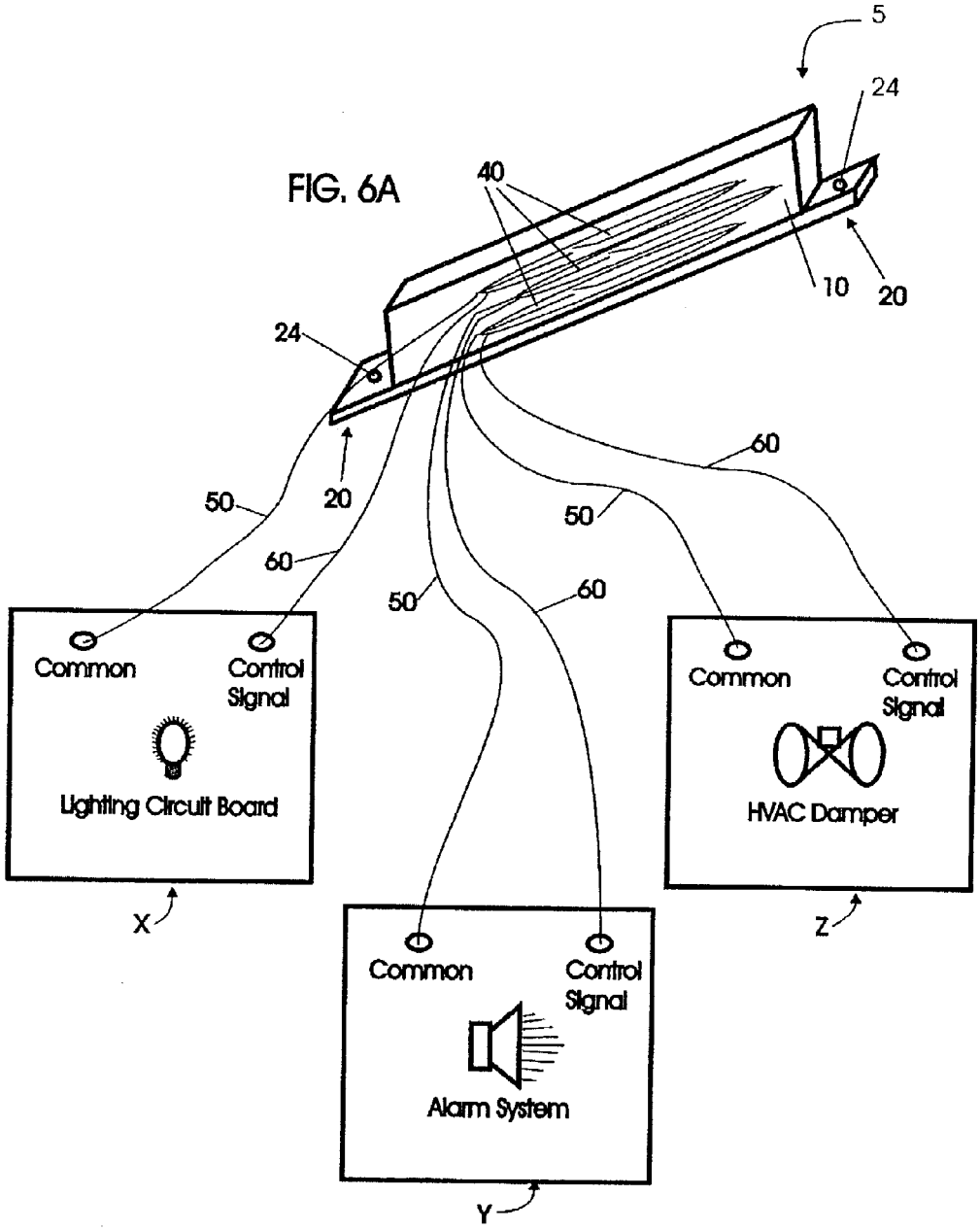
FIG. 6A shows an illustrative embodiment of a use of the reed switch apparatus of FIG. 6 in the control of multiple devices.

FIG. 6A is an illustrative embodiment of a use of the reed switch apparatus 5 shown in FIG. 6 to control multiple systems or devices. In this illustrative embodiment, each of the three reed switches 40 in reed switch apparatus 5 interface or communicate with a separate system or device. Each device or system in this embodiment is independent of the other, utilizing its own reed switch with corresponding control signal and corresponding common to be able to operate properly. In other words, the devices or systems do not use a common reed switch. In other embodiments, to the extent foreseeable by on or ordinary skill in the art, each of the reed switches 40 in reed switch apparatus 5 can communicate a signal, which ultimately controls several devices. The systems or devices have been indicated in this embodiment as a lighting circuit board X, alarm system Y, and HVAC damper Z. In this interface, an electrical signal can be sent through switch control 60. When the device's corresponding reed switch 40 is closed (when magnet is present), the electrical signal will be relayed back through commons 50, indicating to that device or system that its circuit is closed. All three reed switches 40 in this embodiment are normally closed. As such, the signals from the switch controls 60 are not being relayed back through commons 50. When the reed switch apparatus 5 is exposed to a magnetic field (for example, placing a magnet within close proximity to the reed switch apparatus 5), the reed switches 40 move to the closed position and the communicative signal is relayed back to each respective device or system—e.g, the circuit is closed. When the reed switch apparatus 5 is not exposed to a magnetic field (for example, removing a magnet from close proximity to the reed switch apparatus 5), the reed switches 40 move to the open position and the communicative signal is no longer relayed back to each respective device or system—e.g, the circuit is open. In this regard, it should become apparent to one of ordinary skill in the art that each device or system (e.g, X, Y, and Z) can determine what actions to take upon either receiving a signal or not receiving a return signal. For example, the alarm system can activate upon the lack of a signal being returned.

As another example, intended for illustrative purposes only, the reed switch apparatus 5 can include two reed switches 40—one that is normally open and one that is normally closed (not shown). The reed switch apparatus 5 can be placed on a window near a magnet, such that when the window is closed, the magnetic field causes both reed switches 40 to be in the activated or normal state. In this illustration, the normally open reed switch 40 can interface or communicate with an internal siren and the normally closed reed switch 40 can communicate with a security system. With both reed switches 40 being activated, the security system in communication with the normally closed reed switch 40 receives an electrical signal, while the internal siren in communication with the normally open reed switch 40 does not receive an electrical signal. When the window is open, the magnetic field is removed from the reed switches 40 and returns the reed switches 40 to their non-normal state—in this case, the switch to the internal siren being closed and the switch to the security system being opened. The security system, in not receiving a return signal because of the open circuit, recognizes that the window is open and the siren, in receiving the electrical signal because the circuit is closed, initiates.

While several structures have been shown with reference to the embodiments of FIG. 1–6, the actual dynamics and physical features of the reed switch housing 10 will depend on the desired use.

In operation, the embodiments of the reed switch apparatus 5 described with reference to FIGS. 1–6 can be used in many applications to control a multiplicity of devices when exposed to a single magnetic field. In this regard, the reed switch apparatus 5 can utilize several reed switches 40, each of the reed switches 40 being either normally opened or normally closed. As the reed switches 40 are closely packed or sandwiched in close proximity to one another, they can all be activated at the same time with a single magnetic field. The magnetic field as will be commonly recognized by one of ordinary skill in the art can be created by either a permanent magnet or one generated through an electromechanically activated coil. Utilizing several of these reed switches 40 in reed switch apparatus 5 allows communication to be established with several devices at the same instance, but independent of one another. In other words, each of the reed switches 40 in reed switch apparatus 5 need not utilize a common circuit; each of the reed switches 40 can have their own circuit As mentioned herein, in some embodiments the reed switches 40 in the reed switch apparatus 5 can communicate with several devices. With these embodiments, as well as others described herein, the channels of communication can be in many forms. In simpler embodiments, a direct hard wired communication channel is used where the communicative signal is sent or received directly from the leads 30 of the reed switch apparatus 5. In other embodiments, the communicative signal can be sent across a wireless connection. As one example, the wireless communication can be digital, being based upon the Institute of Electrical and Electronics Engineers 802.12 wireless standard (IEEE 802.12, 1998 Edition (ISO/IEC 8802-12:1998)) or those based upon the Bluetooth wireless standard. Other wireless communications include infrared, radio signals, and the like. In other embodiments, the channels of communication can include various combinations.

FIGS. 7–10 show in an illustrative view one use of the reed switch apparatus 5. This illustration is intended to only be explanatory thereof and is not intended to preclude other uses, which are available to the extent foreseeable by one of ordinary skill in the art. Generally shown in FIG. 7 is a door 500 of the roll-up type, which is flexible enough to move from a vertically closed position to its rolled-up position at the top of the guide track 410. As shown in FIG. 8, the door 500 is corrugated permitting it to coil up on a rotatable support rod 300. A disc 310 is mounted on each end of the rotatable support rod 300 for retaining each end of the door 500 as it is wound up. Items typically used in such roll-up doors are also shown, including a door stop 420, which prevents the door 500 from further rotation around support rod 300 when a door plate (not shown) on the bottom of the door 500 comes in contact therewith.

The reed switch apparatus 5, as mentioned above, can be mounted in several places—dependent on use. In FIG. 7, the reed switch apparatus 5 is shown mounted via attachment device 20 to track 410 on a roll-up door 500. A single reed switch apparatus 5 with multiple reed switches 40 such as this can interface with multiple systems. Such a multiple system interface is discussed below with reference to FIGS. 11 and 12. When the door 500 is completely closed, a magnet 520 (in this embodiment, shown as a permanent magnet) is within close proximity to the reed switch apparatus 5 (seen in FIGS. 7–10). This magnet 520, as indicated with references to the several embodiments, forces the reed switch 40 to either close a circuit or open a circuit (depending on whether each of the reed switches 40 is a normally open reed switch or a normally closed reed switch 40).

FIG. 8 is a cross section of FIG. 7 cut across lines 8—8, showing in a different view how the reed switch apparatus 5 can come in close proximity with magnet 520. In this view, the reed switches 40 in reed switch apparatus 5 would be active or in a "normal" state as the magnet 520 is within close proximity to reed switch apparatus 5. As the door 500 rolls up and around disc 310 (generally indicated in the direction of arrow C), the magnet 520 moves out of close proximity and the reed switches 40 are no longer activated.

FIG. 9 is a cross section of FIG. 7, cut across lines 9—9, showing the details of mounting reed switch apparatus 5 via attachment device 20 to the track 410. As can be seen in this figure, the attachment device 20 can be a bracket—allowing the reed switch apparatus 5 to indirectly connect to track 410.

FIG. 10 is a cross section of FIG. 7, cut across lines 10—10, showing in a more detailed view the reed switch apparatus 5 in close proximity to the magnet 520. The reed switch apparatus 5 has been mounted to the track 410 via attachment device 20. As can be seen in this figure, several reed switches 40 are housed within the reed switch housing 10. The reed switch housing 10 operates in a similar manner to that described with reference to FIGS. 2 and 3, the switch housing including an outer body 15 and a buffer with a resilient material 25 and a gas-blend 35. This buffer helps protect the reed switches 40 from breaking. While such a buffer is the preferable design, it is to be expressly understood that buffers need not be utilized in every embodiment and that other buffers can be used to the extent foreseeable by one of ordinary skill in the art. The magnet 520 is mounted to door 500 via mounting material 600 such as silicon. As the reed switch apparatus 5 is within close proximity to the magnet 520, the reed switches 40 are activated or in the normal state. When the door 500 moves up and the magnet 520 moves away from the reed switch apparatus 5, each reed switch 40 changes to its non-normal position.

While the reed switch apparatus 5 has been described as utilizing a plurality of reed switches 50 in some embodiments, in other embodiments, the reed switch apparatus 5 can include only a single reed switch 40 to activate a device adapted for use with a warehouse storage structure. In such an embodiment, the warehouse storage structure can be one of those known in the art—e.g., including, but not limited to public storage facilities, military storage warehouses, airport hangers/storage, port warehouse storage, rail warehouse storage, manufacture storage warehouses and the like. The device (in which the reed switch 40 in these embodiments communicate with) can include a light, air conditioning system (HVAC), or the like. As an illustrative example and with general reference to the embodiment in FIG. 7 (discussed above), the reed switch apparatus 5 could utilize one reed switch 40. When that reed switch 40 became exposed to a magnetic field (e.g., in one of the manners described above), communication between the reed switch 40 and the device can be facilitated (e.g., in one of the manners described above). The facilitation of this communication, in turn, allows the magnetically exposed reed switch 40 to activate the device (e.g., light or air conditioning system) off or on—depending on the reed switch 40 being utilized.

With the use of such an embodiment, electrical costs can be saved. For example, once again, with general reference to the embodiment in FIG. 7 (discussed above), a door track 410 with a single a reed switch apparatus 5 (having a single reed switch 40) mounted thereto can activate a light. The door 500, upon opening deactivates the reed switch 40 (via removing the magnetic exposure as described above), which communicates with the light, ultimately activating the light (e.g., turning it on). Contrariwise, the closing of the door 500 applies the magnetic exposure, activating the reed switch 40 thus, turning off the light. Thus, as can be seen the activation of the light between an on and off position can be automatic as the door 500 opens and closes.

Figure 11:
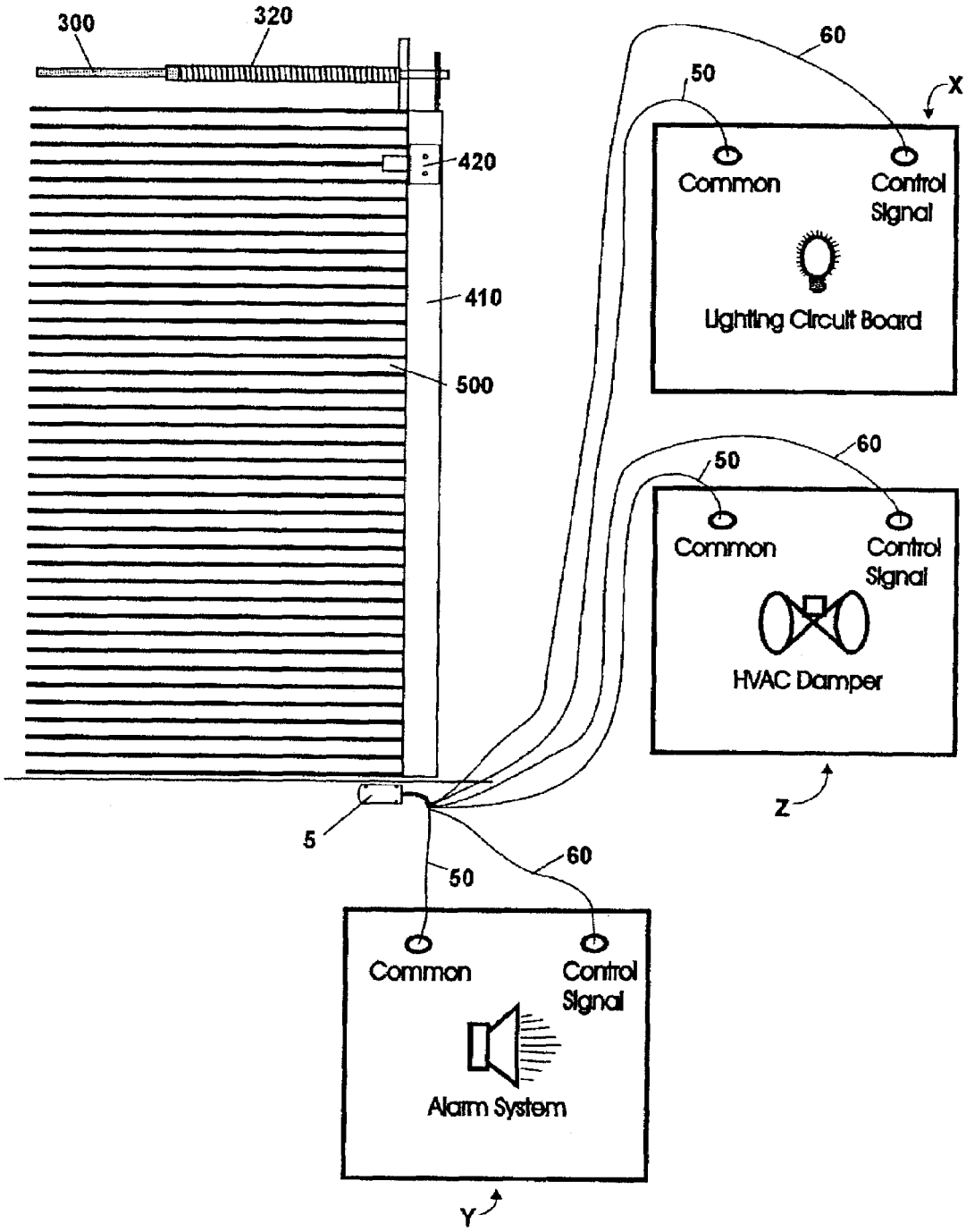
FIG. 11 shows an illustrative embodiment of a use of the reed switch apparatus of FIGS. 7–10 in the communication with multiple devices.

FIG. 11, as indicated above, illustrates the use of a single reed switch apparatus 5 with multiple reed switches 40 (not seen in this embodiment due to perspective) on a roll-up door interfacing with multiple systems or devices. In the embodiment of FIG. 11, reed switch apparatus 5 is mounted on the floor. In the control of multiple devices, the reed switch apparatus 5 in FIG. 11 can, for example, utilize three reed switches 40—one being normally closed and two being normally open. Each of these three reed switches 40 is designed to communicate with only one system or device. In this embodiment, the first normally closed reed switch 40 communicates with an alarm system Y, the first normally open reed switch 40 communicates with an HVAC damper Z, and the second normally open reed switch 40 communicates with a light X. When the door 500 is closed, the magnet 520 (not shown) is in close proximity to reed switch apparatus 5 and hence all three reed switches 40 are in the "normal position". As such, the normally open reed switches 40 have an opened circuit (the light X and the HVAC damper Z) and the normally closed reed switch 40 has a closed circuit (the alarm system Y). When the door 500 is opened, the magnet 520 moves out of close proximity, completing the circuit for the normally opened switch (turning on light X and the HVAC damper Z) and opens the circuit for the normally closed reed switch 40 (alarm system Y does not receive signal sent—indicating the door is open). All devices or systems are signaled simultaneously when one single magnet is moved within close proximity to the reed switch apparatus 5, insuring that all the devices or systems work together seamlessly.

Figure 12:
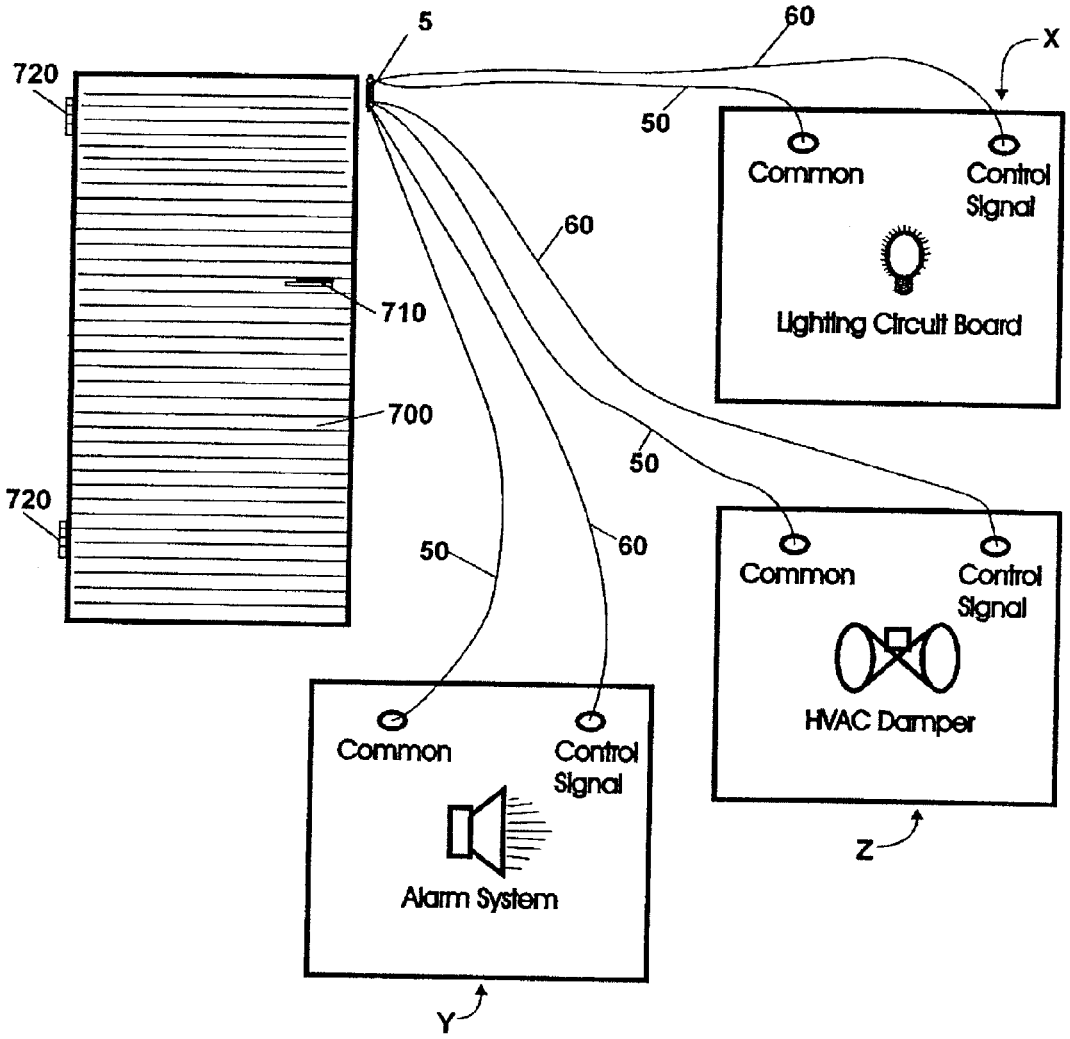
FIG. 12 shows another illustrative embodiment of a use of the reed switch apparatus in the communication with multiple devices.

FIG. 12, in a manner similar to that described with reference to FIG. 11 illustrates the use of a single switch apparatus 5 with multiple reed switches 40 (once again, not seen in FIG. 12 due to perspective) interfacing with multiple systems or devices. The devices or systems have been indicated as a lighting circuit board X, an alarm system Y, and an HVAC damper Z. In this embodiment, reed switch apparatus 5 is shown mounted at an adjacent location to a swing door 700—e.g., for example, of the type that could be utilized with a storage shed or the like, including standard features such as hinges 720 and a latch 710. The magnet (not shown) can be mounted on an inside portion of the swing door 700 such that when the swing door 700 is closed, the reed switch apparatus 5 is within close proximity to the magnet (not shown).

FIGS. 13 and 14 show another embodiment of the reed switch apparatus 5, being utilized on a door track 610. In this embodiment, the magnet 600 and reed switch apparatus 5 remain in a single location while a door latch 630 interrupts the exposure of the magnetic field from magnet 600 on the reed switches 40 of the reed switch apparatus 5. Both the reed switch apparatus 5 and magnet 600 are mounted to the door track 610 via an attachment device 640 and attachment screws 650. The door track 610 has a hole 620 which is arranged and designed to receive a door latch 630.

As shown in FIG. 14, the door latch 630 extends through the hole 620 between the magnet 600 and reed switch apparatus 5, interrupting the exposure of the magnetic field caused by magnet 600 on reed switch apparatus 5. When the door latch 630 is removed from a location between the magnetic 600 and reed switch apparatus 5, the magnetic field from magnet 600 once again exposes the reed switch apparatus 5.

FIG. 13A shows a more detailed view of the reed switch apparatus of FIG. 13. As can be seen in this configuration, the reed switch apparatus 5 need not have a single housing surrounding the reed switches 40. Rather, as can be seen in this embodiment, the reed switch apparatus 5 has three reed switches 40—all with their own housing 65. Therefore, it is to be expressly understood with the embodiments, generally described in FIGS. 1–14 that a single housing 10 (seen, for examples, in embodiment of FIGS. 1–3) can be a multiplicity of housing 65 (seen, for example, in the embodiment of FIGS. 13 and 13A).

As shown and discussed with reference to several of the embodiments described herein, reed switch apparatus 5 can be seen as a control system, arranged and designed to control a plurality of devices or systems. A plurality of the reed switches 40 in a reed switch apparatus 5 lie in very close proximity to one another such that the reed switch 40 can be activated simultaneously via exposure of the reed switch apparatus 5 to a single magnetic field. Thus, the reed switch apparatus 5 advantageously allows a simultaneous establishment of communication with multiple devices. Additionally, with other embodiments, the reed switch apparatus 5 can utilize one or more reed switches 40 to activate a device, adapted for use with a warehouse storage structure—e.g., including, but not limited to lights, air conditioning systems, and the like.

It is to be expressly understood that while the reed switch apparatus 5 has been illustrated in several embodiments with regards to specific uses, it can be utilized in other settings to the extent foreseeable. For example, the reed switch apparatus 5 could be utilized next to a window. As such, the foregoing disclosure and description of the invention are only illustrative and explanatory thereof. Various changes in the details of the illustrated apparatus and construction and method of operation may be made to the extent foreseeable without departing from the spirit of the invention.

I claim:

1. A reed switch apparatus for independently communicating with a plurality of devices in a building structure having a door or window assembly, the reed switch apparatus comprising:

a housing having a plurality of reed switches, wherein each said reed switch independently communicates with a separate device, and said plurality of reed switches are activated by a single constant magnetic field generated by a metal alloy magnet member, and an attachment device for mounting said housing to the door or window assembly.

2. The reed switch apparatus of claim 1, wherein said plurality of reed switches include at least one normally closed reed switch and at least one normally open reed switch.

3. The reed switch apparatus of claim 1, wherein said plurality of reed switches includes at least three reed switches.

4. The reed switch apparatus of claim 1, wherein said activation of said plurality of reed switches is simultaneous.

5. The reed switch apparatus of claim 1, wherein said plurality of reed switches do not share a common circuit.

6. The reed switch apparatus of claim 1, wherein said communication of at least one said reed switch with the separate device is wireless.

7. The reed switch apparatus of claim 1, wherein said plurality of reed switches do not share a common circuit; and said activation of said plurality of reed switches is simultaneous.

8. A method for controlling a plurality of separate devices with a reed switch apparatus, the reed switch apparatus including a plurality of reed switches mounted to a door track of a roll up door, the method comprising the steps of:

exposing a plurality of reed switches to a single magnetic field;

simultaneously activating the plurality of reed switches with the single magnetic field; and facilitating independent communication between one reed switch and one device for each of the plurality of separate devices, there being a single reed switch for every device.

9. The method of claim 8, wherein said step of communication includes utilization of a wireless channel of communication.

10. The method of claim 8, wherein each of the plurality of reed switches do not share a common circuit.

11. The method of claim 8, wherein the plurality of reed switches include at least three switches and the plurality of devices include at least three devices.

12. A control system for controlling a first device and a second device, comprising:

a reed switch apparatus having first and second reed switches, each said reed switch having a signal lead and a common lead, said signal and common leads of said first reed switch adapted to controllably connect to the first device and said signal and common leads of said second reed switch adapted to controllably connect to the second device, each said reed switch having open and closed positions with the switch position dependent upon the presence or absence of a magnetic field acting upon said reed switch; and a permanent magnet member capable of providing a magnetic field sufficient to simultaneously alter said positions of said first and second reed switches as said magnet member and said reed switches are brought in close proximity to each other, wherein the simultaneous change of switch positions allows said first reed switch to control the first device and said second reed switch to control the second device.

13. The control system of claim 12, wherein the first device being controlled by said first reed switch is a light.

14. The control system of claim 13, wherein the second device being controlled by said second reed switch is an air conditioning system.

15. In a warehouse structure, a method of interfacing with a plurality of separate devices utilizing a magnet member and a reed switch apparatus including a plurality of reed switches, the method comprising the steps of:

mounting the reed switch apparatus to a first component of the warehouse structure;

mounting the magnet member to a second component of the warehouse structure;

coupling a first reed switch in the reed switch apparatus to a first device;

coupling a second reed switch in the reed switch apparatus to a second device, wherein each reed switch has an open position and a closed position and is magnetically activated and each device has an on position and an off position; and exposing the first and second reed switches to a magnetic field from the magnet member to change the on-off position of the first device and the second device.

16. The method of claim 15, wherein said step of exposing the first and second reed switches to a magnetic field results in the simultaneous change in the open-closed position of the first and second reed switches.

17. The method of claim 16, wherein said step of exposing the first and second reed switches to a magnetic field results in the simultaneous change in the on-off position of the first and second devices.

18. The method of claim 15, wherein the first reed switch is not coupled to the second reed switch.

19. The method of claim 15, wherein said reed switch apparatus mounting step includes mounting the reed switch apparatus to a door guide or frame and said magnet member mounting step includes mounting the magnet member to a door.

20. The method of claim 19, wherein in the closed position of the door the magnetic field of the magnet member is exposed to the first and second reed switches.

21. The method of claim 20, wherein the door is a roll-up door.

22. The method of claim 15, wherein the first device is an alarm system.

23. The method of claim 22, wherein the second device is a light or an air conditioning system.

24. The method of claim 15, further comprising the step of:

coupling a third reed switch in the reed switch apparatus to a third device; and wherein said step of exposing the first and second reed switches to a magnetic field further comprises exposing the first, second and third reed switches to the magnetic field from the magnet member to simultaneously change the open-closed positions of the three reed switches.

25. The method of claim 24, wherein the first, second and third reed switches are independent of one another.

26. The method of claim 24, wherein the first, second and third devices are independently coupled to the first, second and third reed switches respectively.

27. The method of claim 26, wherein the three devices include an alarm system, a light, and an air conditioning system.

28. The method of claim 24, wherein said coupling steps comprise a first circuit including the first reed switch controlling the first device, a second circuit including the second reed switch controlling the second device, and a third circuit including the third reed switch controlling the third device, wherein the first, second and third circuits are independent of one another.

29. The method of claim 28, wherein the plurality of reed switches include at least one normally closed reed switch and at least one normally open reed switch.

* * * * *